US007186296B2

(12) United States Patent
Sasaki

(10) Patent No.: US 7,186,296 B2
(45) **Date of Patent: *Mar. 6, 2007**

(54) FILM FORMATION APPARATUS

(75) Inventor: Tsutomu Sasaki, Kaisei-machi (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/293,219

(22) Filed: Dec. 5, 2005

(65) Prior Publication Data

US 2006/0124057 A1 Jun. 15, 2006

(30) Foreign Application Priority Data

Dec. 9, 2004 (JP) ..... 2004-357042

(51) Int. Cl.
*B05C 19/06* (2006.01)

(52) U.S. Cl. ..... 118/665; 118/688; 118/712

(58) Field of Classification Search ..... 118/713, 118/688, 665, 612, 309, 312, 300, 712, 308
See application file for complete search history.

(56) References Cited

U.S. PATENT DOCUMENTS 5,529,815 A * 6/1996 Lemelson ..... 427/575
5,800,615 A * 9/1998 Lambert et al. ..... 118/326
2004/0026030 A1* 2/2004 Hatono et al. ..... 156/279
2004/0151978 A1* 8/2004 Huang ..... 429/83
2004/0197493 A1* 10/2004 Renn et al. ..... 427/596
2005/0098103 A1* 5/2005 Miyoshi ..... 118/712
2005/0115500 A1* 6/2005 Vardelle et al. ..... 118/688
2005/0120952 A1* 6/2005 Vardelle et al. ..... 118/715
2005/0199603 A1* 9/2005 Vardelle et al. ..... 219/130.21
2005/0223977 A1* 10/2005 Vardelle et al. ..... 118/663

FOREIGN PATENT DOCUMENTS

JP 2001-348659 A 12/2001
JP 2002-030421 A 1/2002

OTHER PUBLICATIONS

Machine Translation of JP 2001-348659 (Submitted with.*

* cited by examiner

*Primary Examiner*—George Koch
(74) *Attorney, Agent, or Firm*—Sughrue Mion, PLLC

(57) ABSTRACT

A film formation apparatus by which a film thickness can be precisely measured and whether the film quality is good or bad can be confirmed in a process of performing film formation according to the aerosol deposition method. The film formation apparatus includes: an aerosol generating unit for generating an aerosol by dispersing a raw material powder by a gas; a holding unit for holding a substrate on which a structure is to be formed; a nozzle for injecting the aerosol generated by the aerosol generating unit toward the substrate; and a measurement unit for measuring an electric potential of a film formation surface on the substrate.

10 Claims, 6 Drawing Sheets

FILM FORMATION APPARATUS

BACKGROUND OF THE INVENTION

1. Field of the Invention

The present invention relates to a film formation apparatus for forming a structure on a substrate by spraying a law material powder at a high speed and deposit the powder thereon.

2. Description of a Related Art

Recent years, in the field of micro electrical mechanical system (MEMS), fabrication of sensors, actuators, or the like employing piezoelectric ceramic by film formation has been studied in order to further integrate those elements for practical use. As one of the film formation methods, the aerosol deposition (AD) method known as a technology for forming a film of ceramic, metal, etc. receives attention. The AD method is a film formation method of generating an aerosol containing a raw material powder and injecting it toward a substrate from a nozzle and depositing the raw material on the substrate. Here, the aerosol refers to solid or liquid fine particles floating in a gas.

In the AD method, the raw material powder accelerated at a high speed under a certain condition collides against an under layer such as the substrate or a previously formed deposition materials, etc. and cut into it, and, at the time of collision, the powder is crushed into particles of several tens of nanometers and new active surfaces appears, and then, film formation is performed by mechanochemical reaction in which the active surfaces firmly bind together. According to the AD method, a dense and strong thick film including no impurities can be formed. Accordingly, it is expected that a ceramic piezoelectric film to be used for piezoelectric actuators, piezoelectric pumps, inkjet printer heads, ultrasonic transducers, etc. is formed by the AD method, and thereby, the performance of those devices is improved. In addition, the AD method is also referred to as injection deposition method or gas deposition method.

In the AD method, it is not easy to fabricate a ceramic structure having a uniform film thickness and uniform film quality, and therefore, control of the film thickness and film quality becomes a problem. Since the film formation speed in the AD method vary delicately according to various conditions such as aerosol concentration, injection speed of aerosol, scan speed of nozzle and film formation temperature, the film thickness cannot be precisely controlled only by adjusting the film formation time, and the film quality easily changes according to those conditions.

As a related technology, Japanese Patent Application Publication JP-P2001-348659A (page 1 and FIG. 1) discloses an apparatus for fabricating a ceramic structure according to the gas deposition method of spraying an aerosol containing ceramic fine particles on a substrate at a high speed to form a ceramic structure, in which an aerosol containing many primary particles of ceramic in a stable amount over time is generated for adjusting the height of the ceramic structure. In the apparatus for fabricating a ceramic structure, the amount of ceramic fine particles in the aerosol is detected by a sensor, and a signal output from the sensor is fed back to the apparatus for fabricating a ceramic structure.

However, according to JP-P2001-348659A, only the amount of ceramic fine particles in the aerosol, i.e., aerosol concentration is detected by the sensor, but fine particles having different particle diameters and agglomerated particles, which cannot contribute to film formation, contained in the aerosol are not distinguished. Generally, in the case where film formation is performed by employing an aerosol containing many agglomerated particles under the same condition as the normal condition, a structure in a compressed powder state containing many air holes is formed, and thereby, the film quality as represented by density becomes deteriorated. That is, according to the method disclosed in JP-P2001-348659A, the film thickness of the structure (structure height) can be controlled, but the film quality cannot be controlled.

Further, Japanese Patent Application Publication JP-P2002-30421A (page 1 and FIG. 1) discloses a method of forming an ultrafine particle film in an arbitrary film thickness in a gas deposition apparatus, including an ultrafine particle generation chamber provided with an evaporation source and an opening portion of a carrier pipe above the evaporation source and a film formation chamber provided with a nozzle coupled to another opening portion of the carrier pipe and a stage for fixing a substrate provided facing the nozzle thereon, for forming a film by carrying ultrafine particles evaporated from the evaporation source with a gas introduced into the ultrafine particle generation chamber in the carrier pipe and depositing the ultrafine particles injected from the nozzle on the substrate. In the method of producing an ultrafine particle film, the film thickness of the formed ultrafine particle film is measured by a laser film thickness gauge as a contactless film thickness gauge at the same time when an ultrafine particle film is formed on the substrate, and the relative speed between the stage and the nozzle, evaporation source temperature and so on are controlled based on a result of the film thickness measurement.

However, according to the method disclosed in JP-P2002-30421A, it is inevitable that the fine particles, that have been injected from the nozzle but not involved in film formation, adhere to the laser film thickness gauge provided within the chamber, and therefore, the method is unsuitable for film formation for a long period and productivity is low. Further, likewise in JP-P2001-348659A, the film thickness can be controlled but the film quality cannot be confirmed on the moment.

Thus, in JP-P2001-348659A and JP-P2002-30421A, the film quality of the structure cannot be confirmed or controlled. Further, it is still difficult to control the film thickness precisely on the order of micron even by using any one of those methods. For example, in the case where a piezoelectric actuator is fabricated by the AD method, when the film thickness is nonuniform, the applied electric fields vary among plural elements and properties vary, and thereby, the yield in the finished product is reduced. Accordingly, the cost of manufacturing rises. Further, in the case where the structure contains many air holes, this causes reduction in withstand pressure and reduction in density numerically expressed by an elastic modulus and Vickers hardness, and therefore, dielectric breakdown is likely to occur during operation in the finished product.

SUMMARY OF THE INVENTION

The present invention has been achieved in view of the above-mentioned problems. An object of the present invention is to provide a film formation apparatus by which a film thickness can be precisely measured and whether the film quality is good or bad can be confirmed in a process of performing film formation according to the AD method.

In order to solve the above-mentioned problems, a film formation apparatus according to one aspect of the present invention includes: aerosol generating means for generating an aerosol by dispersing a raw material powder by a gas;

holding means for holding a substrate on which a structure is to be formed; a nozzle for injecting the aerosol generated by the aerosol generating means toward the substrate; and measuring means for measuring an electric potential of a film formation surface on the substrate.

According to the present invention, the deposition rate and the density of the structure during film formation can be confirmed on the moment by measuring the electric potential of the film formation surface on the substrate, which is correlated with the deposition rate and the density. Accordingly, the deposition height (film thickness) of the structure can be precisely controlled on the order of micron and the density of the structure can be maintained by adjusting various film formation conditions based on such a potential difference. Therefore, a high quality structure with uniform thickness and high density can be fabricated, and the reliability of a device using such a structure can be improved and the cost of manufacturing can be reduced.

DESCRIPTION OF THE PREFERRED EMBODIMENTS

Figure 1:
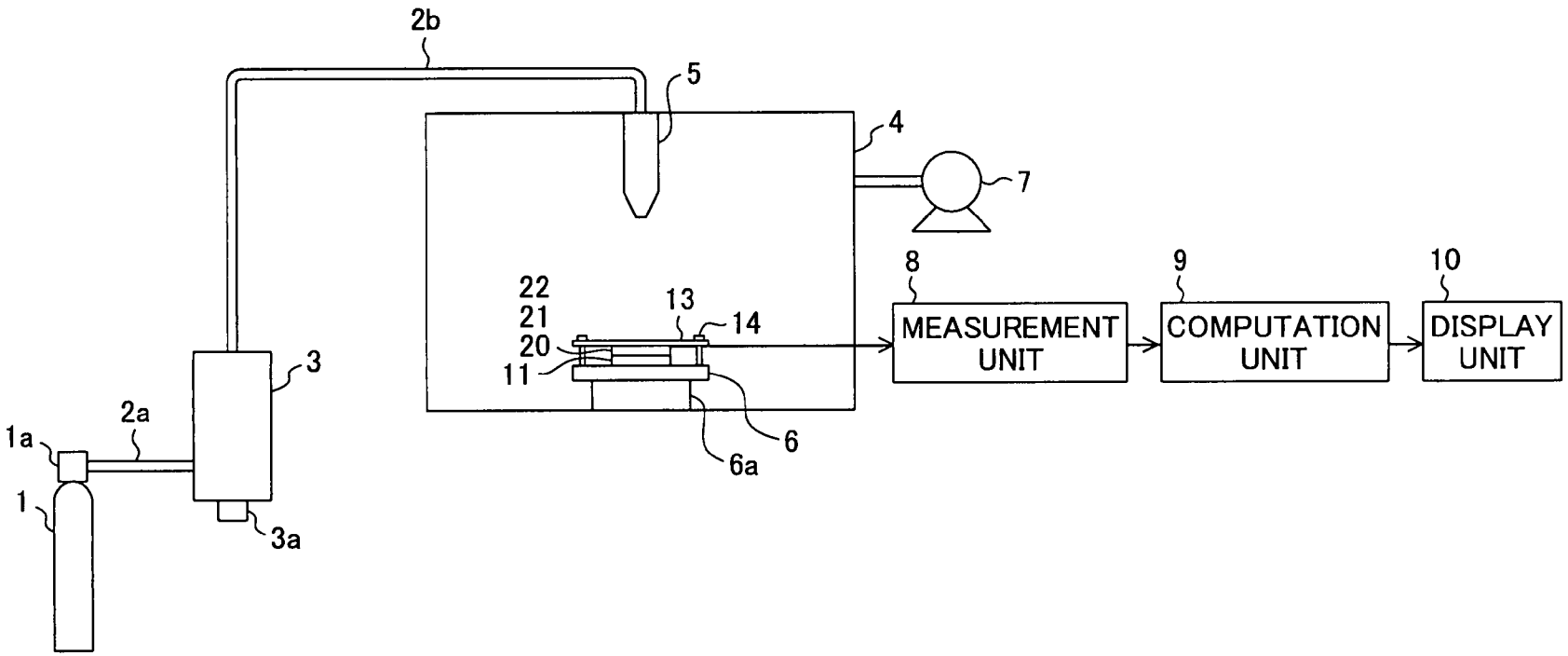
FIG. 1 is a schematic diagram showing a constitution of a film formation apparatus according to the first embodiment of the present invention.

Hereinafter, preferred embodiments of the present invention will be described in detail by referring to the drawings. The same reference numerals are assigned to the same component elements and the description thereof will be omitted.

FIG. 1 is a schematic diagram showing a film formation apparatus according to the first embodiment of the present invention. The film formation apparatus includes a compressed gas cylinder 1, carrier pipes 2*a* and 2*b*, an aerosol generation part including an aerosol generation chamber 3, a film formation chamber 4 in which film formation is performed, a nozzle 5 and a substrate holder 6 provided in the film formation chamber 4, an exhaust pump 7, a measurement unit 8, a computation unit 9 and a display unit 10.

The compressed gas cylinder 1 is filled with oxygen ($O_2$) to be used as a carrier gas. Further, in the compressed gas cylinder 1, a pressure regulation part 1*a* for regulating the supplied amount of the carrier gas is provided. As the carrier gas, nitrogen ($N_2$), helium (He), argon (Ar) dry air, or the like may be used other than that.

The aerosol generation chamber 3 is a container in which a micro powder of a raw material as a film formation material is disposed. An aerosol is generated by introducing the carrier gas via the carrier pipe 2*a* into the aerosol generation chamber 3 and dispersing the raw material powder by the gas.

In the aerosol generation chamber 3, there is provided a container driving part 3*a* for providing micro vibration or relatively slow motion to the aerosol generation chamber 3. Here, the raw material powder (primary particles) located in the aerosol generation chamber 3 is agglomerated by the electrostatic force, Van der Waals force or the like as time passes and form agglomerated particles. Among them, giant particles of several micrometers to several millimeters are also large in mass and collect at the bottom of the container. If they collect near the exit of the carrier gas (near the exit of the carrier pipe 2*a*), the primary particles cannot be blown up by the carrier gas. Accordingly, in order not to allow the agglomerated particles to collect at one place, the container driving part 3*a* provides vibration or the like to the aerosol generation chamber 3 so as to agitate the powder located within the chamber.

The nozzle 5 injects the aerosol supplied from the aerosol generation chamber 3 via the carrier pipe 2*b* toward a substrate 20 at a high speed. The nozzle 5 has an opening having a predetermined shape and size (e.g., on the order of 5 mm in length and 0.5 mm in width).

In the substrate holder 6, a jig 11, a jig mask 13 and a bolt 14 are provided. These substrate holder 6 and parts 11, 13 and 14 form a holding part for holding the substrate 20. Further, in the substrate holder 6, a substrate holder driving part 6*a* is provided, and thereby, the relative position and the relative speed between the nozzle 5 and the substrate 20 are controlled in a three-dimensional manner.

The exhaust pump 7 exhausts the air within the film formation chamber 4 so as to hold a predetermined degree of vacuum.

The measurement unit 8 measures the potential difference between the electric potential of a surface of a lower electrode 22 formed on the substrate 20 and the ground potential. That is, with reference to the ground potential, the electric potential of a surface of the lower electrode 22 is measured. In the embodiment, an oscilloscope manufactured by Agilent Technologies Japan, Ltd. is used as the measurement unit 8.

Further, the computation unit 9 obtains a deposition rate and Vickers hardness of the structure during fabrication on the substrate 20 and calculates the deposition height (film thickness) of the structure etc. based on the electric potential of a surface of the lower electrode 22 measured by the measurement unit 8. Their calculation principles will be described later.

Furthermore, the display unit 10 includes a display device such as a CRT, an LCD or the like, and displays the electric potential of a surface of the lower electrode 22 measured by the measurement unit 8, the film thickness calculated by the computation unit 9, etc. in the display device.

Figure 2A:
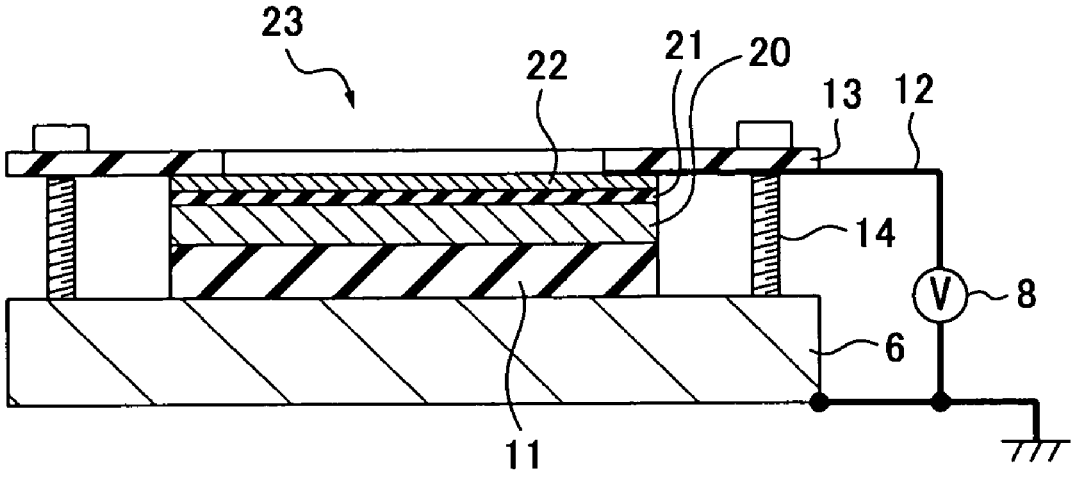
FIGS. 2A and 2B are enlarged views showing around a substrate holder shown in FIG. 1.
Figure 2B:
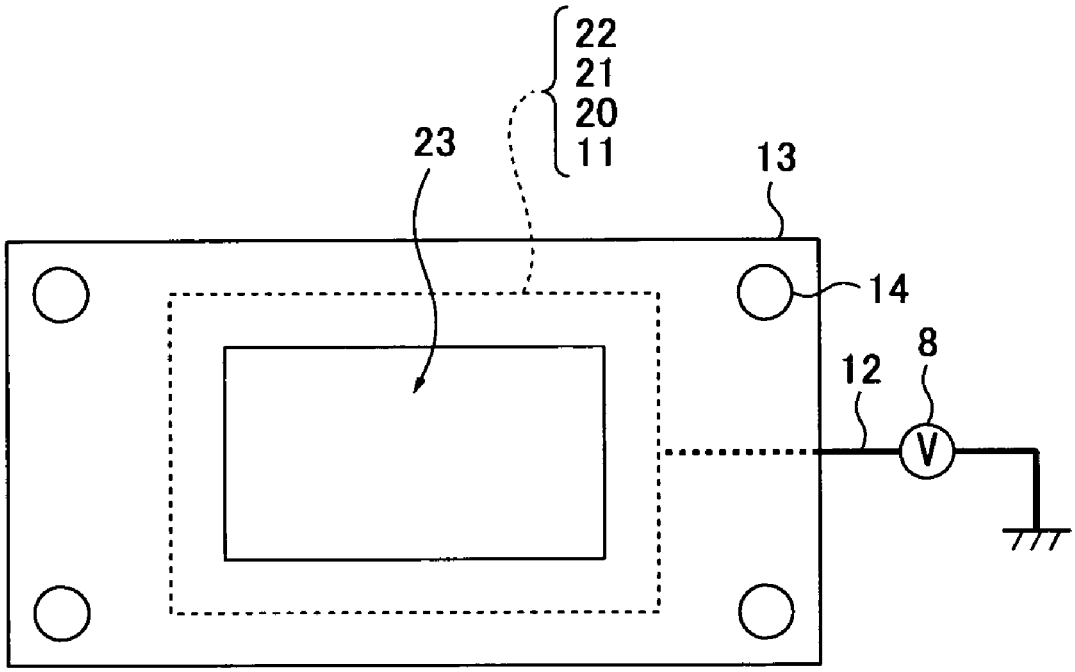

FIG. 2A is an enlarged sectional view showing around the substrate 20 and the substrate holder 6 shown in FIG. 1 and FIG. 2B is a plan view of the same.

As shown in FIG. 2A, the substrate 20 is formed by a silicon (Si), for example. Further, on the substrate 20, a silicon dioxide ($SiO_2$) film (insulating film) 21 and the lower electrode 22 including a metal film of titanium (Ti), titanium oxide ($TiO_2$), iridium (Ir), iridium oxide ($IrO_2$), tantalum oxide ($TaO_3$), platinum (Pt) or the like have been formed in advance.

Further, the substrate holder 6 is connected to the ground potential. The substrate 20 is mounted on the jig 11, and the jig mask 13 is provided thereon. The jig 11 and the jig mask 13 are formed by an insulating material such as zirconia, alumina, or glass, for example. Further, a conducting wire 12 to be used for measuring the electric potential of the film formation surface in contact with the lower electrode 22 is provided to the jig mask 13. The position of the substrate 20 is fixed by fastening the bolt 14 that supports the jig mask 13. Thereby, the substrate 20 is held in a condition in which the substrate 20 electrically floats from the ground potential and the lower electrode 22 and the conducting wire 12 are electrically connected to each other. By the way, a heater for keeping the substrate 20 at predetermined temperature may be provided within the substrate holder 6.

As shown in FIG. 2B, an opening is formed in the jig mask 13. The region on the substrate 20 exposed through the opening is a film formation region 23.

Referring to FIG. 1 again, in such a film formation apparatus, the substrate 20 on which the lower electrode 22 and so on have been formed is disposed on the substrate holder 6 and the interior of the film formation chamber 4 is exhausted to a predetermined degree of vacuum by using the exhaust pump 7. Further, a raw material powder having a predetermined particle diameter is disposed in the aerosol generation chamber 3. Then, by supplying the carrier gas such as nitrogen via the carrier pipe 2*a* into the aerosol generation chamber 3, the raw material powder is dispersed and an aerosol is generated. The aerosol is supplied via the carrier pipe 2*b* to the nozzle 5 and injected toward the substrate 20 from the nozzle 5. Thereby, the raw material powder contained in the aerosol collides against the lower electrode 22 and attaches onto the lower electrode 22 to form a film. Meanwhile, the measurement unit 8 measures the electric potential of the lower electrode 22, i.e., the electric potential of the film formation surface, and the computation unit 9 obtains the deposition rate and Vickers hardness and estimates the film thickness of the formed structure based on the measurement value by the measurement unit B.

Next, the calculation principle of the thickness etc. in the computation unit 9 shown in FIG. 1 will be described by referring to FIGS. 3–10. FIGS. 3–8 show changes of the electric potential of the lower electrode 22 shown in FIG. 1 (i.e., the electric potential of the film formation surface).

As below, the case where a PZT (Pb (lead) zirconate titanate) film is formed as a structure will be described. As a material powder, PZT having an average particle diameter of 0.3 μm is used. Further, hereinafter, the deposition rate refers to a value obtained by dividing the thickness of a film formed by moving the substrate at 0.5 mm/s relative to the nozzle by the number of times of reciprocation of the nozzle. Furthermore, the film quality of the formed film is evaluated on Vickers hardness. That is, the higher Vickers hardness, denser and stronger the film is, and the lower Vickers hardness, softer with more air holes the film is.

Figure 3:
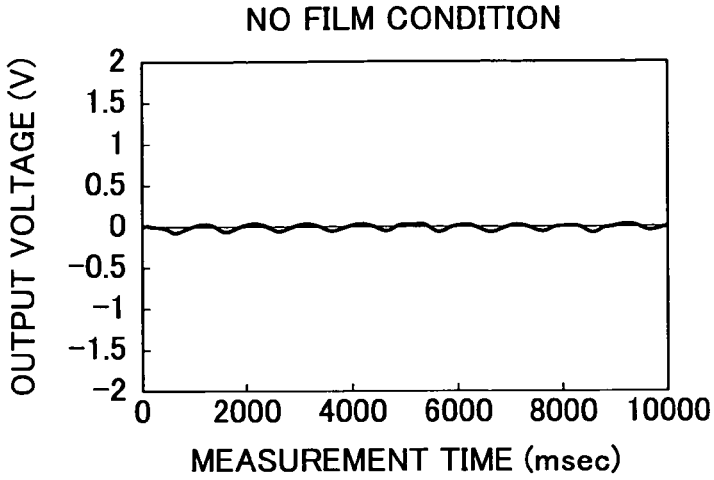
FIG. 3 shows a potential change of a film formation surface in a condition in which no film is formed thereon.

FIG. 3 shows a potential change of the film formation surface in a condition in which no PZT film is formed on the substrate 20. That is, although the film formation apparatus shown in FIG. 1 is driven, an aerosol is sprayed only on the jig mask 13 part by shifting the nozzle 5 from the film formation region 23 shown in FIG. 2B. As shown in FIG. 3, in this case, there is little potential change.

Figure 4:
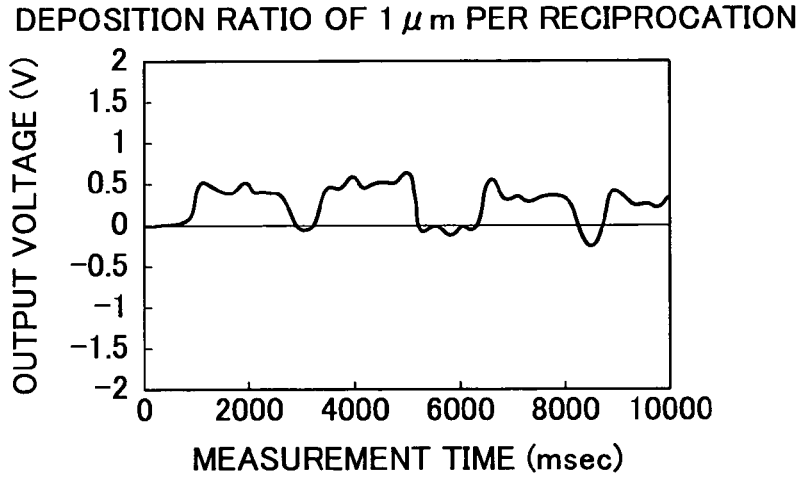
FIG. 4 shows a potential change of the film formation surface in the case where the deposition rate is 1 μm per reciprocation.

FIG. 4 shows a potential change of the film formation surface in a condition in which a PZT film is formed on the substrate 20. As shown in FIG. 4, an electric potential of about 0.5V is produced during film formation (about 1000 msec to about 2800 msec, about 3200 msec to about 5200 msec, about 6500 msec to about 8200 msec, and about 9000 msec or more). The reason why the electric potential decreases to near 0V around about 1000 msec, about 3000 msec, about 5800 msec, and 8500 msec in FIG. 4 is that the nozzle 5 deviates from the film formation region 23 when the direction of motion of the substrate 20 is reversed relative to the nozzle 5 and no PZT film has been formed.

In this case, the deposition rate of the formed PZT film is about 1 μm per reciprocation. Further, Vickers hardness of the formed PZT film is measured as about 620. From the high Vickers hardness, it can be said that the raw material powder is crushed on the order of several tens of nanometers, the mechanochemical reaction that the crushed surface adheres to the under layer occurs during the film formation, and the raw material powder is deposited while strongly binding to one another in the case as shown in FIG. 4.

As clearly seen by comparison between FIG. 3 and FIG. 4, a predetermined potential is produced on the film formation surface by film formation on the substrate 20.

Figure 5:
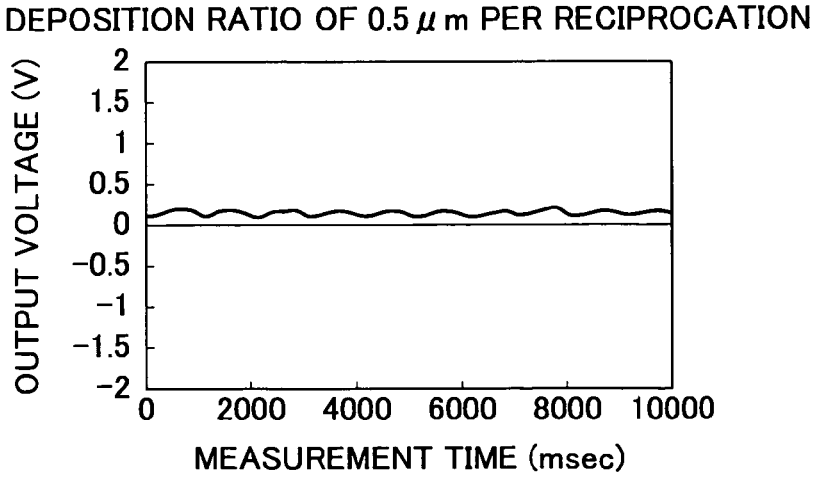
FIG. 5 shows a potential change of the film formation surface in the case where the deposition rate is 0.5 μm per reciprocation.

FIG. 5 shows a potential change of the film formation surface in the case where the deposition rate is reduced by reducing the aerosol concentration below that of the case shown in FIG. 3. As shown in FIG. 5, the electric potential produced during film formation is about 0.25V. Further, the deposition rate of the formed PZT film is about 0.5 μm per reciprocation, and the Vickers hardness is about 600.

Figure 6:
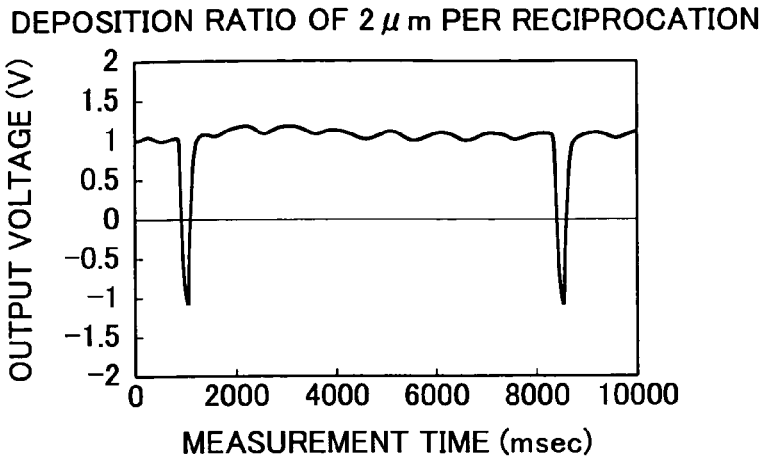
FIG. 6 shows a potential change of the film formation surface in the case where the deposition rate is 2 μm per reciprocation.

FIG. 6 shows a potential change of the film formation surface in the case where the deposition rate is increased by increasing the aerosol concentration higher than that in the case as shown in FIG. 3. As shown in FIG. 6, the electric potential produced during film formation is about 1V. Further, the deposition rate of the formed PZT film is about 2 μm per reciprocation, and the Vickers hardness is about 600. The drops of the electric potential seen in FIG. 6 around about 1000 msec and about 8500 sec are noise.

Figure 7:
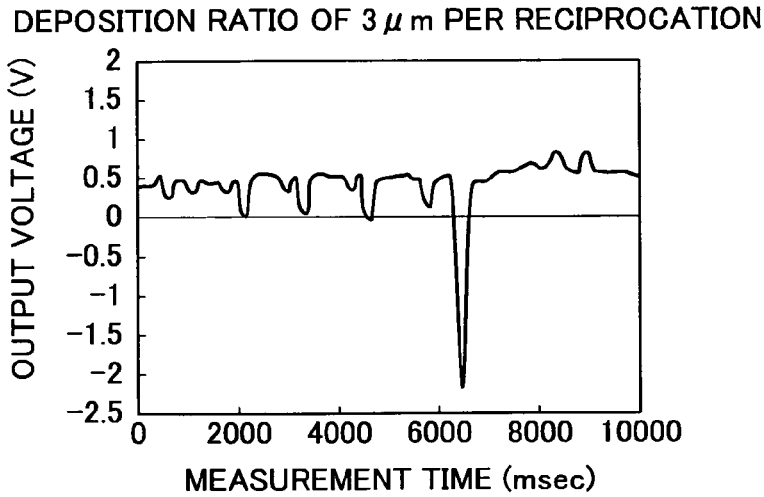
FIG. 7 shows a potential change of the film formation surface in the case where the deposition rate is 3 μm per reciprocation.

FIG. 7 shows a potential change of the film formation surface in the case where the aerosol concentration is further increased higher than that in the case as shown in FIG. 6. As shown in FIG. 7, the electric potential of about 0.5V is produced during film formation and a lot of noise is produced. Further, the deposition rate of the formed PZT film is about 3 μm per reciprocation, and the Vickers hardness is about 400. From the reduction in Vickers hardness compared to the cases as shown in FIGS. 4 to 6, it is considered that, in this case, although the mechanochemical reaction occurs, the rate of occurrence is lower than those in the cases as shown in FIGS. 4 to 6, and the binding in the material powder partially becomes weak.

Figure 8:
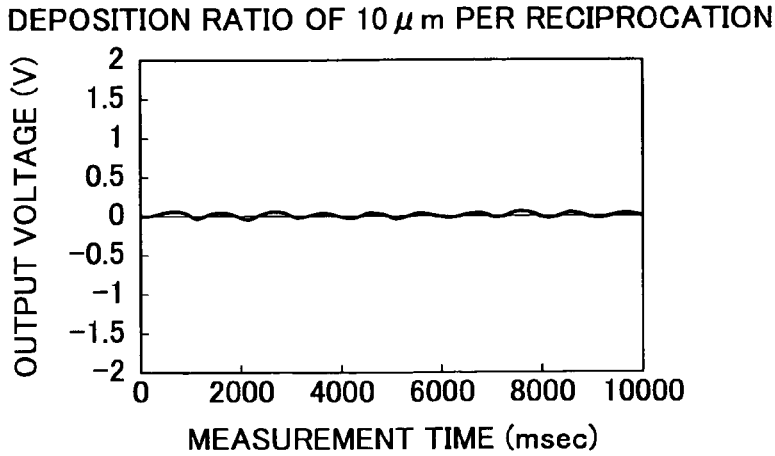
FIG. 8 shows a potential change of the film formation surface in the case where the deposition rate is 10 μm per reciprocation.

FIG. 8 shows a potential change of the film formation surface in the case where the aerosol concentration is further increased higher than that in the case as shown in FIG. 7. As shown in FIG. 8, in this case, the potential production can hardly be recognized even during the during film formation. Further, the deposition rate of the formed PZT film is about 10 μm per reciprocation, and the Vickers hardness is about 200. From the drastic reduction in Vickers hardness, it is considered that the formed PZT film in this case is in a state of green compact having many air holes, which is generally formed by packing a powder. The reason why such a PZT film is formed is that the raw material powder has been agglomerated in the carried aerosol because of the increase in aerosol concentration and the mechanochemical reaction has not been promoted on the film formation surface.

Figure 9:
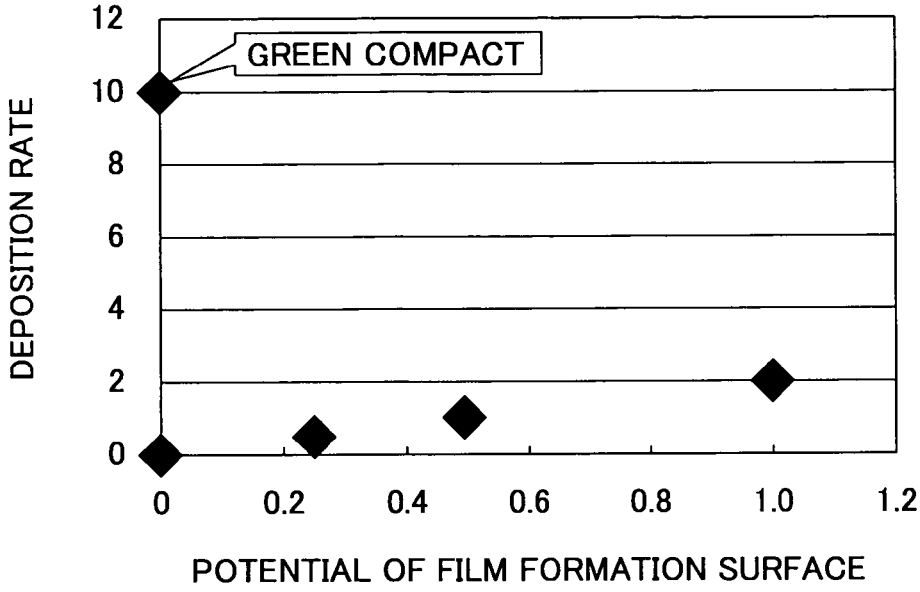
FIG. 9 shows relationships between the deposition rate and the electric potential of the film formation surface.

FIG. 9 shows relationships between the deposition rate and the electric potential of the film formation surface in the cases as shown in FIGS. 3–8 in the range in which the electric potential of the film formation surface is 1.2V or less.

As shown in FIG. 9, in the case where the mechanochemical reaction occurs during film formation (deposition rate=0.25 μm per reciprocation, 0.5 μm per reciprocation, and 1 μm per reciprocation), there is a correlation between the deposition rate and the electric potential, and the electric potential of the film formation surface changes in proportion to the deposition rate. However, as shown in FIG. 6, as the deposition rate becomes higher, the noise components are produced more easily. Further, as shown in FIG. 7, as the deposition rate is made even higher, the mechanochemical reaction becomes difficult to occur, the electric potential of the film formation surface becomes lower, and the correlation is no longer seen between the deposition rate and the electric potential. Furthermore, as shown in FIG. 8, as the deposition rate is made extremely higher (the deposition rate=10 μm per reciprocation), no potential is produced on the film formation surface and the formed PZT film results in a green compact state.

Figure 10:
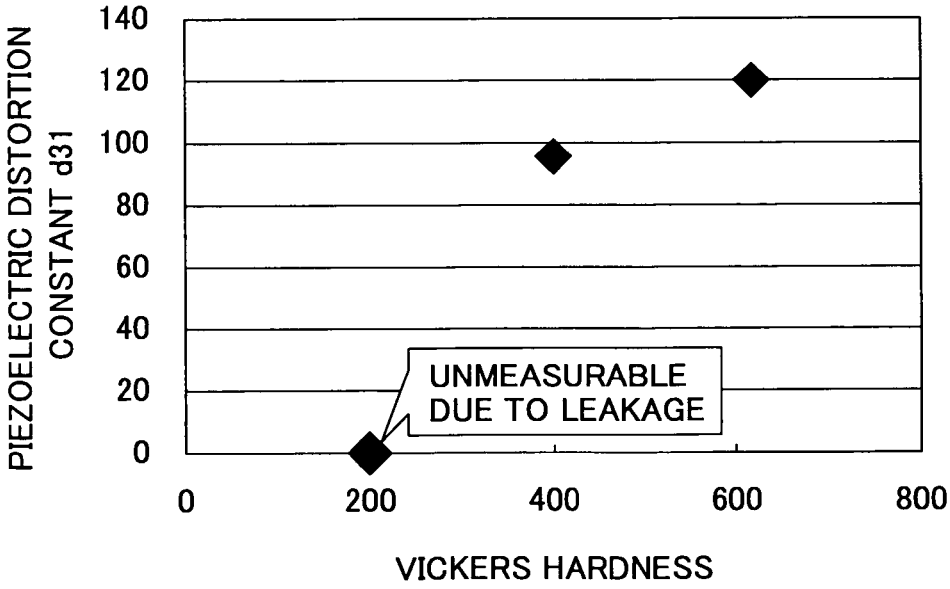
FIG. 10 shows a relationship between Vickers hardness of a PZT film and piezoelectric distortion constant d31.

FIG. 10 shows a relationship between the Vickers hardness of the formed PZT film and piezoelectric distortion constant d31. Like in the cases shown in FIGS. 4 to 6, the piezoelectric distortion constant d31 of the PZT film having Vickers hardness of about 600 becomes about 120. That is, it can be said that the film has a good piezoelectric property. However, like in the case shown in FIG. 7, when the Vickers hardness becomes lower to near 400, accordingly the piezoelectric distortion constant d31 becomes lower to 100 or less. Furthermore, in the case as shown in FIG. 8 where the Vickers hardness is about 200, the piezoelectric distortion constant d31 cannot be measured because leakage occurs. Thus, in the condition in which the Vickers hardness is low, the deterioration of piezoelectric property can be confirmed.

As described above, in the case where the deposition rate is controlled by the aerosol concentration, there is an appropriate range of deposition rate in which a good-quality film can be formed. Further, within the range (e.g., the electric potential of the film formation surface is 1V or less), the deposition rate and the electric potential of the film formation surface show a proportional relationship. Accordingly, the electric potential of the film formation surface is measured during film formation and the respective parts of the film formation apparatus are adjusted so that the measurement value may be kept in a predetermined range, and thereby, a good-quality film, which is dense and strong with a film thickness precisely controlled, can be formed. Further, a structure having a desired thickness can be formed by estimating the film thickness based on the deposition rate.

Referring to FIG. 1 again, the computation unit 9 has tables or relational expressions representing a relationship between the electric potential of the film formation surface and the deposition rate and a relationship between the electric potential of the film formation surface and Vickers hardness, a relational expression to be used for calculating a film thickness based on the time integration value of the electric potential of the film formation surface and the deposition rate, and so on. These tables etc. have been created according to conditions such as a kind and a particle diameter of the raw material powder, a substrate material, a movement speed of the substrate, film formation temperature and so on. The computation unit 9 obtains the deposition rate, Vickers hardness, film thickness, etc. of the structure during fabrication based on the electric potential of the film formation surface measured by the measurement unit 8 and the above-mentioned tables etc. The value obtained by the computation unit 9 is displayed in the display unit 10.

An operator manually adjusts the respective parts of the film formation apparatus so as to obtain desired film thickness and film quality based on the electric potential of the film formation surface, deposition rate, Vickers hardness, film thickness, etc. displayed in the display unit 10. For example, the following part is a target of adjustment. That is, the aerosol concentration can be adjusted by controlling the pressure regulation part 1*a* to adjust the flow rate of the carrier gas supplied to the aerosol generation chamber 3 and controlling the container driving part 3*a* to provide appropriate vibration to the aerosol generation chamber 3. Further, the operator may adjust the movement speed of the substrate holder 6 by controlling the substrate holder driving part 6*a*. Furthermore, in the case where the electric potential of the film formation surface contains a lot of noise components, that indicates that the aerosol concentration is high. In this case, the operator can reduce the aerosol concentration by adjusting the pressure regulation part 1*a* and the container driving part 3*a*.

Conventionally, the film thickness of the ceramic structure has been adjusted empirically or sensually according to time, visual observation or the like. On the other hand, according to the embodiment, the progress status of the film formation is expressed in numeric values based on the electric potential of the film formation surface, the film thickness can be controlled precisely or objectively on the order of micron, and the film quality can be held at a certain level or above.

In the embodiment, the case of forming the PZT film has been described, however, the present invention can be applied to the case where various ceramic structures are fabricated by employing brittle materials in general, lead-based piezoelectric materials, non-lead piezoelectric materials such as $KNbO_3$, dielectric materials such as $BaTiO_3$, insulating materials such as $Al_2O_3$, AlN, or $ZrO_2$, optical materials such as PLZT, etc. as long as they can be used in the AD method. In this case, tables may be prepared in the computation unit 8 by obtaining data shown in FIG. 3–10 according to the kind of ceramic structure, the diameter of raw material powder to be used, etc. in advance.

In the case where the Vickers hardness is low (e.g., 500 or less) and the formed film diffusely reflects in white like the case shown in FIG. 8, the film is in a state of green compact in which the powder is packed. In this case, the deposition rate extremely rises and the electric potential of the film formation surface is no longer observed. Accordingly, the green compact state and the normal film formation state by mechanochemical reaction can be discriminated during film formation. Further, when tables or the like are created, the data in the state in which the green compact is formed is desirably removed by detecting the aerosol concentration.

Figure 11:
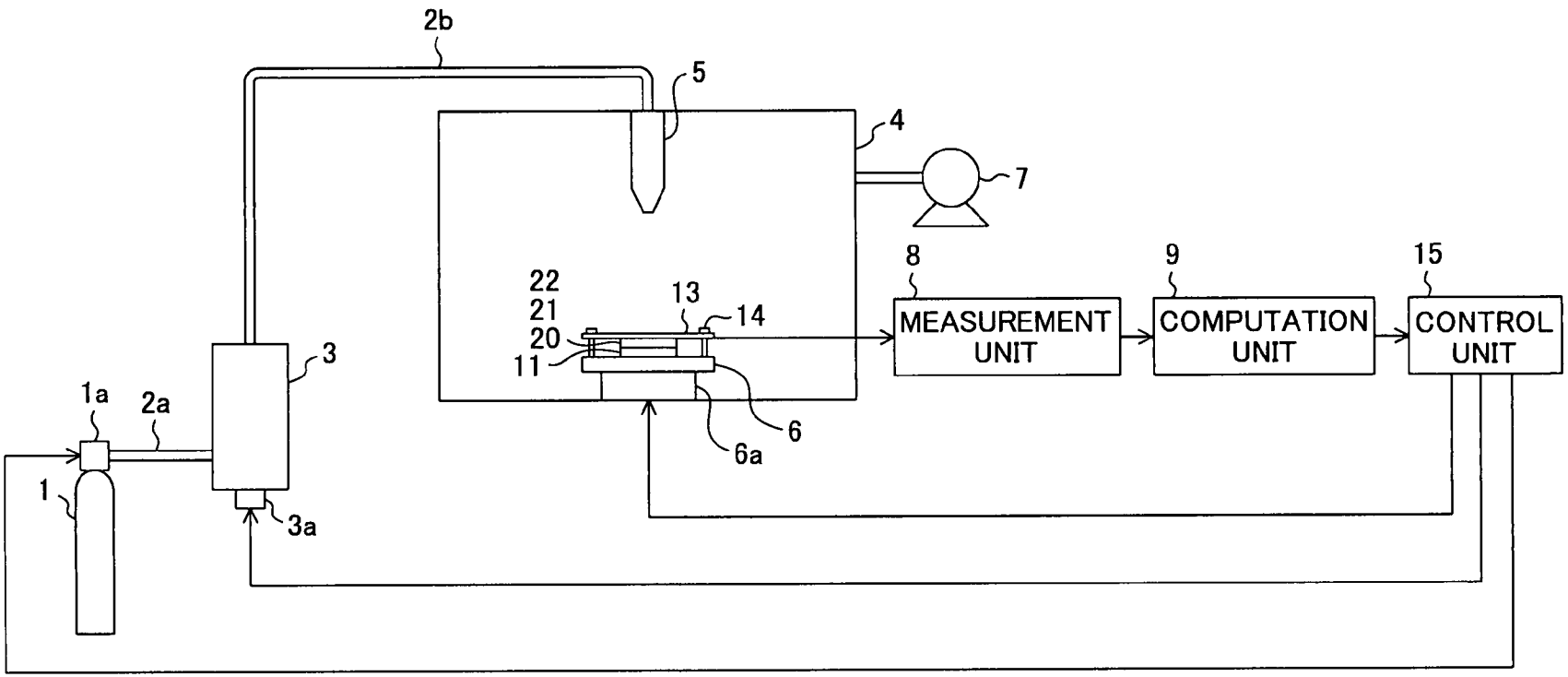
FIG. 11 is a schematic diagram showing a constitution of a film formation apparatus according to the second embodiment of the present invention.

Next, a film formation apparatus according to the second embodiment of the present invention will be described. FIG. 11 is a schematic diagram showing the film formation apparatus according to the embodiment.

The film formation apparatus shown in FIG. 11 has a control unit 15 in place of the display unit 10 shown in FIG. 1. Other constitution is the same as the film formation apparatus shown in FIG. 1.

The control unit 15 controls the operation of the respective parts of the film formation apparatus so that a structure having present film thickness and film quality may be obtained based on the deposition rate, Vickers hardness, film thickness, etc. obtained by the computation unit 9 by utilizing the electric potential of the film formation surface measured by the measurement unit 8. That is, the control unit 15 controls the pressure regulation part 1*a* to change the flow rate of the carrier gas, controls the container driving part 3*a* to adjust the aerosol concentration, and/or controls the substrate holder driving part 6*a* to adjust the movement speed of the substrate 20 relative to the nozzle 5. Further, the control unit 15 controls the respective parts of the film formation apparatus to finish film formation when the thickness of the formed film reaches the preset value. Furthermore, in the case where the electric potential of the film formation surface contains a lot of noise components, the control unit 15 adjusts the pressure regulation part 1*a* or the container driving part 3*a* to reduce the aerosol concentration into the suitable range.

Thus, the thickness of the formed structure can be automatically controlled precisely while maintaining the film quality of the structure by feeding back the values of the deposition rate etc. obtained based on the electric potential of the film formation surface to the respective parts of the film formation apparatus.

Further, as a modified example of the film formation apparatus according to the embodiment, the display unit 10 shown in FIG. 1 may be provided to the film formation apparatus shown in FIG. 11. In the case, both the automatic control by the control unit 15 and the user control by referring to the screen of the display unit 10 can be performed.

As described above, according to the first and second embodiments of the present invention, the deposition rate changing according to the aerosol concentration can be held uniformly over a long period. Thereby, the larger area of the structure, the thicker film of the structure, and resolution in variations in film thickness can be promoted, and accordingly, the degree of freedom of design of the structure can be increased. For example, since voltages applied to plural piezoelectric elements can be uniformized by using a piezoelectric material that has been controlled so that the film thickness may be uniform, a piezoelectric actuator with stable quality can be manufactured with high yield. Alternatively, by applying the piezoelectric material with precisely controlled film thickness to ultrasonic transducers, ultrasonic waves can be efficiently transmitted and an ultrasonic probe capable of detecting ultrasonic signals with high sensitivity can be manufactured. In this case, the image quality of ultrasonic images can be improved. Furthermore, in the case where such a piezoelectric material is applied to an inkjet head, the printable image size can be made larger in addition to that the images with higher image quality can be depicted.

Further, in the above-mentioned first and second embodiments of the present invention, the respective parts of the film formation apparatus have been controlled for forming a dense and strong film, however, a film having a desired property can be formed by changing the control method. For example, in the case where a soft structure is desirably formed, a film containing many air holes can be formed by suppressing the mechanochemical reaction by controlling the respective parts according to the electric potential of the film formation surface to increase the aerosol concentration. Alternatively, the Vickers hardness of the formed film can be changed step-by-step or continuously by controlling the respective parts according to the electric potential of the film formation surface to change the aerosol concentration step-by-step or continuously. Such a structure having a property that changes gradually can be utilized as a stress relaxation layer or buffer layer.

By the way, in the first and second embodiments, the aerosol has been generated by introducing the gas into the container in which the raw material powder is disposed, however, the aerosol can be generated by other methods as long as the raw material powder can be dispersed by a gas. For example, the raw material powder may be supplied into a container in which airflow is formed.

The invention claimed is:

1. A film formation apparatus comprising:

aerosol generating means for generating an aerosol by dispersing a raw material powder by a gas;

holding means for holding a substrate on which a structure is to be formed;

a nozzle for injecting the aerosol generated by said aerosol generating means toward said substrate; and measuring means for measuring an electric potential of a film formation surface on said substrate.

2. The film formation apparatus according to claim 1, wherein said measuring means measures the electric potential of the film formation surface on said substrate with reference to a ground potential.

3. The film formation apparatus according to claim 1, further comprising:

computing means for calculating a deposition height of said structure formed by depositing the aerosol injected from said nozzle on said substrate and/or density of said structure based on the electric potential of the film formation surface measured by the measuring means; and display means for displaying the deposition height of said structure and/or the density of said structure calculated by said computing means.

4. The film formation apparatus according to claim 1, further comprising:

control means for controlling a deposition height of said structure and/or a density of said structure based on a measurement result obtained by said measuring means.

5. The film formation apparatus according to claim 4, wherein said control means changes a flow rate of the aerosol injected from said nozzle based on a measurement result obtained by said measuring means.

6. The film formation apparatus according to claim 4, wherein said aerosol generating means has a container in which the raw material powder is disposed, and driving means for providing at least one of vibration and predetermined motion to said container; and said control means controls said driving means based on a measurement result obtained by said measuring means to agitate the raw material powder disposed in said container and change an amount of the raw material powder contained in the aerosol supplied to said nozzle.

7. The film formation apparatus according to claim 4, wherein said control means controls said holding means based on a measurement result obtained by said measuring means to change a relative speed between said nozzle and said substrate.

8. The film formation apparatus according to claim 1, wherein said aerosol generating means has a container in which the raw material powder is disposed and gas introducing means for introducing the gas for blowing up and dispersing the raw material powder into said container.

9. The film formation apparatus according to claim 8, further comprising:

control means for controlling a deposition height of said structure and/or a density of said structure by changing a flow rate of the aerosol injected from said nozzle based on a measurement result obtained by said measuring means.

10. The film formation apparatus according to claim 1, further comprising:

computing means for obtaining a deposition rate of the structure formed by depositing the aerosol injected from said nozzle on said substrate based on the electric potential of the film formation surface measured by said measuring means.

* * * * *